United States Patent [19]

Helderle et al.

[11] Patent Number: 4,651,827

[45] Date of Patent: Mar. 24, 1987

[54] HYDRAULICALLY CONTROLLED SAFETY VALVES FOR INCORPORATION IN PRODUCTION TUBES OF HYDROCARBON PRODUCTION WELLS

[75] Inventors: Paul M. Helderle, Champdeuil; Michel Raimond, La Coquette, both of France

[73] Assignee: Total Compagnie Francaise Des Petroles, Paris, France

[21] Appl. No.: 862,920

[22] Filed: May 14, 1986

[30] Foreign Application Priority Data

May 21, 1985 [FR] France ..... 85 07591

[51] Int. Cl.[4] ..... E21B 33/00

[52] U.S. Cl. ..... 166/317; 166/323; 166/324; 137/68.1

[58] Field of Search ..... 166/317, 321, 323, 324; 137/68.1

[56] References Cited

U.S. PATENT DOCUMENTS 3,786,865 1/1974 Tausck ..... 166/323

4,469,179 9/1984 Crow ..... 166/323 X 4,475,599 10/1984 Akkenman ..... 166/323

4,550,780 11/1985 Mott ..... 166/323

4,566,478 1/1986 Deaton ..... 166/323 X 4,605,070 8/1986 Morris ..... 166/323 X

*Primary Examiner*—Harold W. Weakley

*Attorney, Agent, or Firm*—Sughrue, Mion, Zinn, Macpeak and Seas

[57] ABSTRACT

A safety valve for use in a hydrocarbon production tube comprises a valve member which is opened by a piston tube displaceable as a result of the intake of hydraulic fluid into an operating chamber therefor, and a tubular receptacle for receiving an auxiliary safety valve recoverable by means of a cable. The receptacle is longitudinally displaceable between inactive and active positions and is engaged telescopically with the piston tube in a sealed manner to define, with the piston tube, the operating chamber. The receptacle is normally retained in its inactive position by shearable elements, but after the elements have been sheared, descends to its active position simultaneously driving the piston tube to its lower position to open the valve member.

7 Claims, 8 Drawing Figures

HYDRAULICALLY CONTROLLED SAFETY VALVES FOR INCORPORATION IN PRODUCTION TUBES OF HYDROCARBON PRODUCTION WELLS

The present invention relates to hydraulically controlled safety valves for incorporation in production tubes of hydrocarbon production wells.

Such valves may comprise a closed valve member, and a piston tube which is biased upwardly by a restoring spring and is movable into a lower position for opening the valve member by means of a hydraulic control.

It has been found that, in operation, these valves have certain defects, for example wedging of the valve member in the open position as a result of an incorrect return of the piston tube, the restoring spring of which is located in a chamber inadequately protected from effluent, or leaks of hydraulic control fluid resulting in closure of the valve member.

To make it possible for production to continue in the event that such a safety valve incorporated in a production tube fails to operate, it has already been proposed to provide, in the body of such a safety valve, a receptacle designed to receive an auxiliary safety valve recoverable by means of a cable and a sliding emergency sleeve, making it possible to direct the hydraulic control fluid towards this receptacle for control of the auxiliary safety valve instead of the safety valve incorporated in the production tube. The auxiliary safety valve is equipped with an extension piece which, when the auxiliary safety valve is in the receptacle, keeps the valve member in the open position. However, the manipulation of the emergency sleeve, and subsequently the extension piece with the auxiliary safety valve is a serious handicap. Moreover, the valve member will close again if the auxiliary safety valve is withdrawn.

Consequently, despite the attraction of simplicity and of a wide passage for the effluent which such valves incorporated in the production tubes possess, this type of valve is little used, and it is often preferred to employ safety valves recoverable by means of a cable, which, although they are more complicated and have narrower passages for the effluent, can be changed relatively simply in the event of failure.

According to the present invention there is provided a safety valve comprising an elongate generally cylindrical body for insertion longitudinally between successive elements of a production tube and providing a longitudinal passage, a valve member provided in a lower part of the body for closing the passage against upward flow, a piston tube for opening the valve member, a restoring spring for biasing the piston tube to an upper position, the piston tube being longitudinally slidable downwardly to a lower position for opening the valve member, an operating chamber for receiving pressurized hydraulic fluid and for moving the piston tube to its lower position, a tubular receptacle provided above the piston tube for receiving internally, if required, an auxiliary safety valve recoverable by means of a cable, the receptacle being in a lower part sealingly and telescopically engagable with the piston tube to form an assembly, a lower annular seal carried by the piston tube and sealing against the body, an upper annular seal carried by the receptacle and sealing against the body, the operating chamber comprising an annular chamber formed between the body and the assembly and bounded by the upper and the lower annular seals, shearable means comprising a screw and a closed through-plug arranged below the upper annular seal for maintaining the tubular receptacle in an inactive position fixed relative to the body, a locking ring provided externally on the tubular receptacle, at least one auxiliary annular seal provided on the tubular receptacle below the plug, wherein, on application of sufficient pressure in the longitudinal passage to shear the shearable means, the tubular receptacle is adapted to slide downwardly in the body to an active position, the piston tube being adapted to be driven thereby to its lower position, the upper annular seal and the auxiliary annular seal sealing between the body and the receptacle, and the locking ring engaging a groove in the body when the tubular receptacle is in its active position.

Advantageously, during normal operation of the safety valve, the piston tube and the receptacle isolate from the effluent the entire active part which acts on the piston tube, thus ensuring that the safety valve operates in a highly reliable way. Moreover, it can be very easy to convert the safety valve into one recoverable by means of a cable. Movement of the receptacle downwards should maintain the valve member permanently open, and the receptacle may be adapted to receive a conventional auxiliary safety valve without an extension piece, and which may merely be equipped in its lower part with an adaptor having herringbone seals which take up positions on either side of the orifice in the receptacle resulting from removal of the plug, to make a hydraulic connection controlling the auxiliary valve.

It will be noted that the auxiliary annular seal is inactive during the normal operation of the safety valve. Accordingly, to prevent it from undergoing any mechanical stress under these conditions, it is advantageous to provide a groove in the body opposite the inactive position of the seal.

According to a preferred embodiment, during the normal operatin of the safety valve, an additional annular seal provided on the receptacle between the plug and the upper annular seal is located opposite another groove in the body and forms a seal relative to the said body when the receptacle has been lowered into its active position.

An embodiment according to the invention will now be described, by way of example only, with reference to the accompanying drawings.

Figure 1:
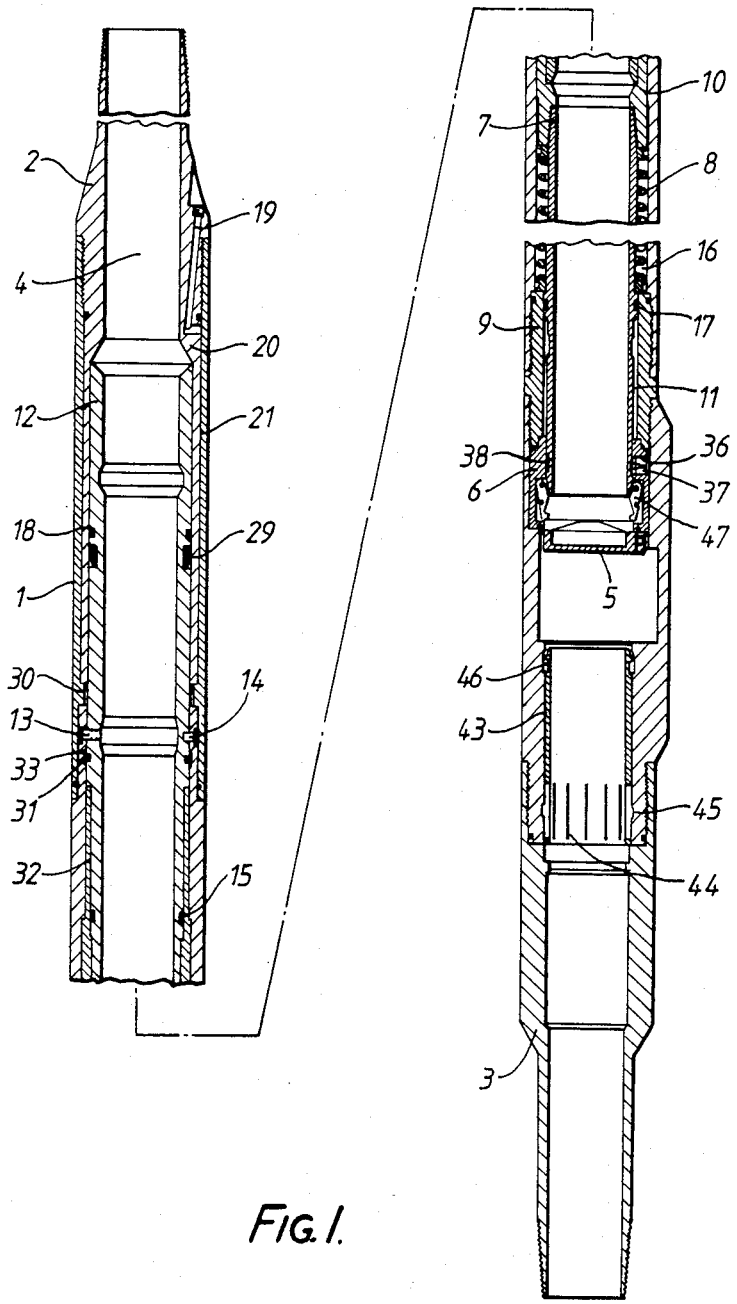
FIG. 1 shows, in longitudinal section, an embodiment according to the invention, with the valve member in a closed position.

FIG. 1 shows a hydraulically controlled safety valve comprising a tubular valve body 1 consisting of several successive components and ending in an upper nipple 2 and a lower nipple 3 which are intended to be connected respectively to the two adjacent elements (not shown) of a production tube, and a longitudinal passage 4 formed inside the body 1 which provides the connection between the longitudinal passages of the production tube elements located on either side of the valve body 1.

A valve member 5 is mounted on a valve member-holder 6 equipped with a valve member hinge pin, a valve member seat and a spring biasing the valve member to the closed position. The valve member-holder 6 may be equipped with other members, which will be described later, for performing various accessory functions.

Figure 2:
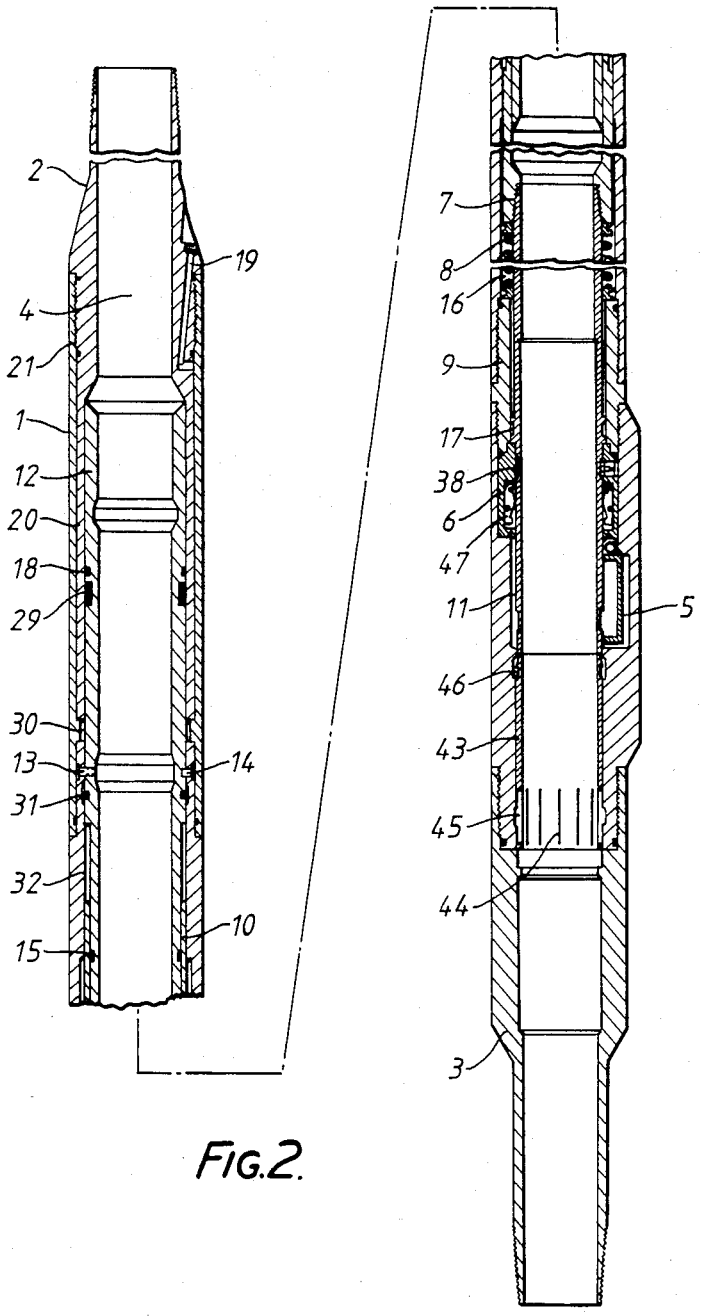
FIG. 2 shows in longitudinal section, the embodiment of FIG. 1 with the valve member in an open position.

The valve member 5 is openable by the descent of a piston tube 7, shown in FIG. 1 in its upper position, to a lower position shown in FIG. 2.

The piston tube 7, which is slidable inside the valve body 1, is biased towards its upper position by a restoring spring 8. The restoring spring 8 bears at one end on the end of a tubular element 9 made integral with the body 1 and located above the valve member-holder 6 and at the other end on the lower end of an upper portion 10 of the piston tube 7, which upper portion 10 is fixed to a lower portion 11 of the piston tube 7. When the piston tube is in the lower position, the lower portion 11 keeps the valve member 5 in the open position and protects the valve member 5 from the flow of effluent.

An emergency receptacle 12, for receiving internally an auxiliary safety valve recoverable by means of a cable, is arranged in the valve body 1 above the piston tube 7 and is slidable downwardly in the body 1 if and when it is freed from shearable elements by which it is fastened to the body 1 during normal operation of the safety valve. The sherable elements comprise a closed plug 13 passing through the wall of the receptacle 12 and at least one screw 14. Shearing is obtained by applying sufficient pressure in the passage 4 when the emergency receptacle 12 is obstructed.

The lower part of the receptacle 12 penetrates telescopically into the upper portion 10 of the piston tube 7, an annular seal 15 ensuring sealing between the receptacle 12 and the piston tube 7.

An operating chamber 16 is formed between the valve body 1 and the assembly consisting of the piston tube 7 and receptacle 12, the chamber extending from a lower annular seal 17 carried by the piston tube 7 and sealing against the body 1, up to an upper annular seal 18 carried by the receptacle 12 and sealing against the body 1. The chamber 16 contains the restoring spring 8 and is supplied with hydraulic oil via an inlet 19 in the upper nipple 2 of the body 1. The nipple 2 extends downwardly in the form of an inner cylindrical skirt 20, against which the upper annular seal 18 bears, whilst an outer wall 21 of body 1 forms, between itself and the skirt 20, an annular passage which allows the hydraulic fluid to enter the operating chamber 16. The hydraulic fluid acts on the piston tube 7 along its length in accordance with the piston tube's differential surfaces, the diameter of the annular seal 15 being a little less than the diameter of the lower annular seal 17. Pressurized hydraulic fluid in the operating chamber 16 therefore acts against the restoring spring 8 to bring the piston tube 7 to its lower valve-member-opening position.

Figure 3:
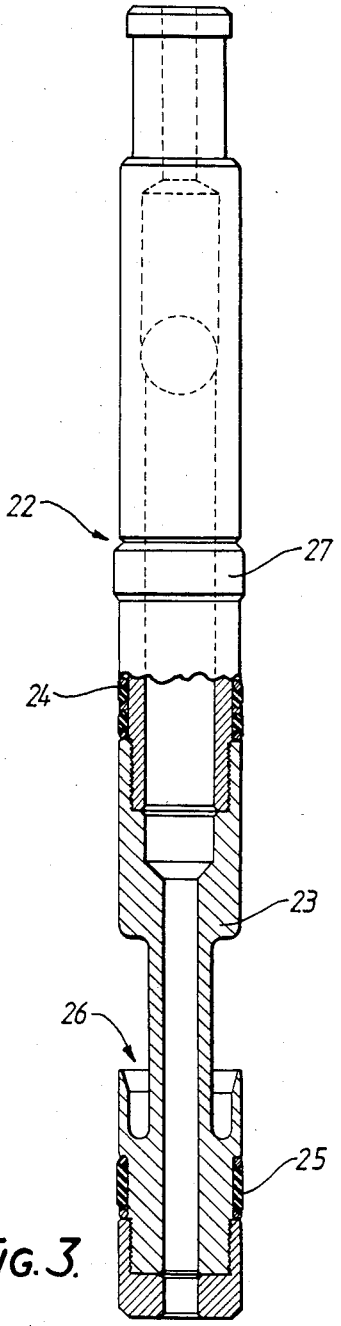
FIG. 3 shows, in elevation and partial longitudinal section, an auxiliary actuating plug for use with the embodiment of FIG. 1.

FIG. 3 shows an auxiliary actuating plug recoverable by means of a cable 22, of which the conventional upper part, for example with a ball valve member, is shown in elevtion, and which is equipped in its lower part with an adaptor 23 carrying herringbone seals 24 and 25 which, when sealing against bearing surfaces of the receptacle 12 on either side of the shearable plug 13, form between them a hydraulic fluid intake chamber for receiving the hydraulic fluid when the plug 13 has been sheared and ejected. A basket 26 is provided in the adaptor 23 to receive the ejected plug 13.

Figure 4:
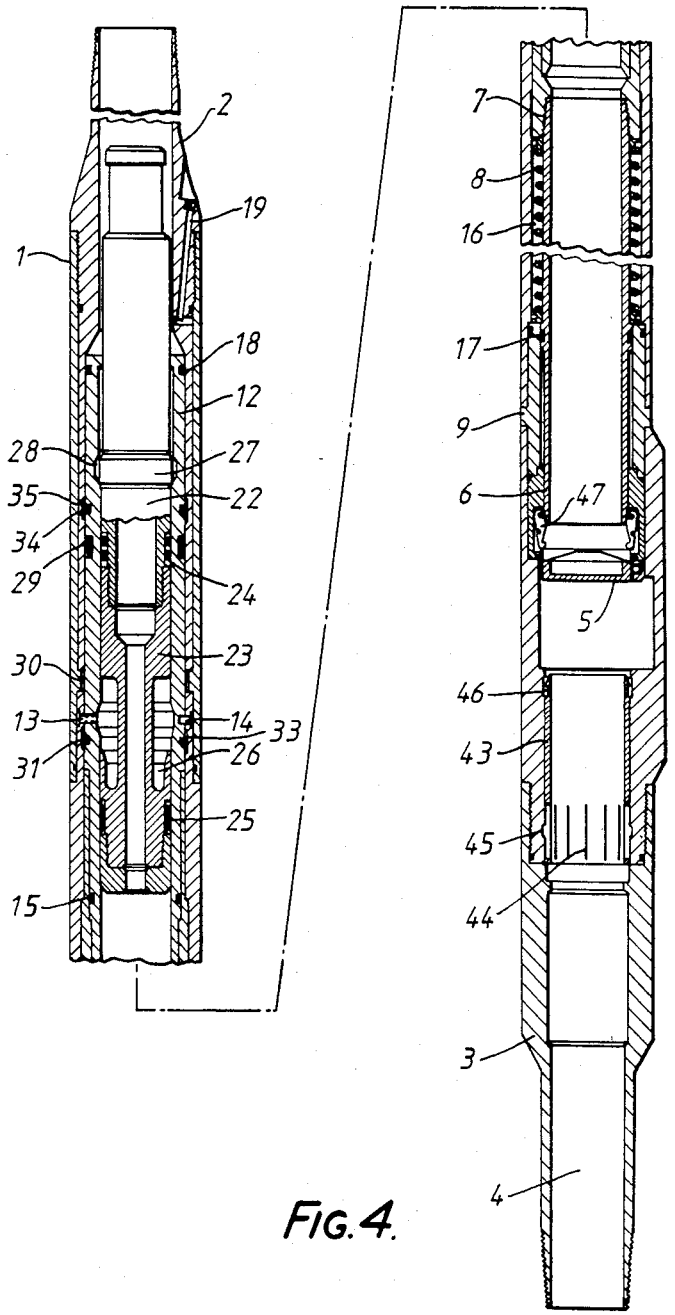
FIG. 4 shows, in longitudinal section, the auxiliary actuating plug of FIG. 3 installed in the embodiment of FIG. 1 with the valve member in a closed position.

FIG. 4 shows the auxiliary plug 22 lowered in to the receptacle 12 before the receptacle 12 has been detached from the body 1. In this position, a shoulder 27 of the actuating plug 22 is retained fixedly in a stop profile 28, called a "NO GO" profile, of the receptacle 12.

Figure 5:
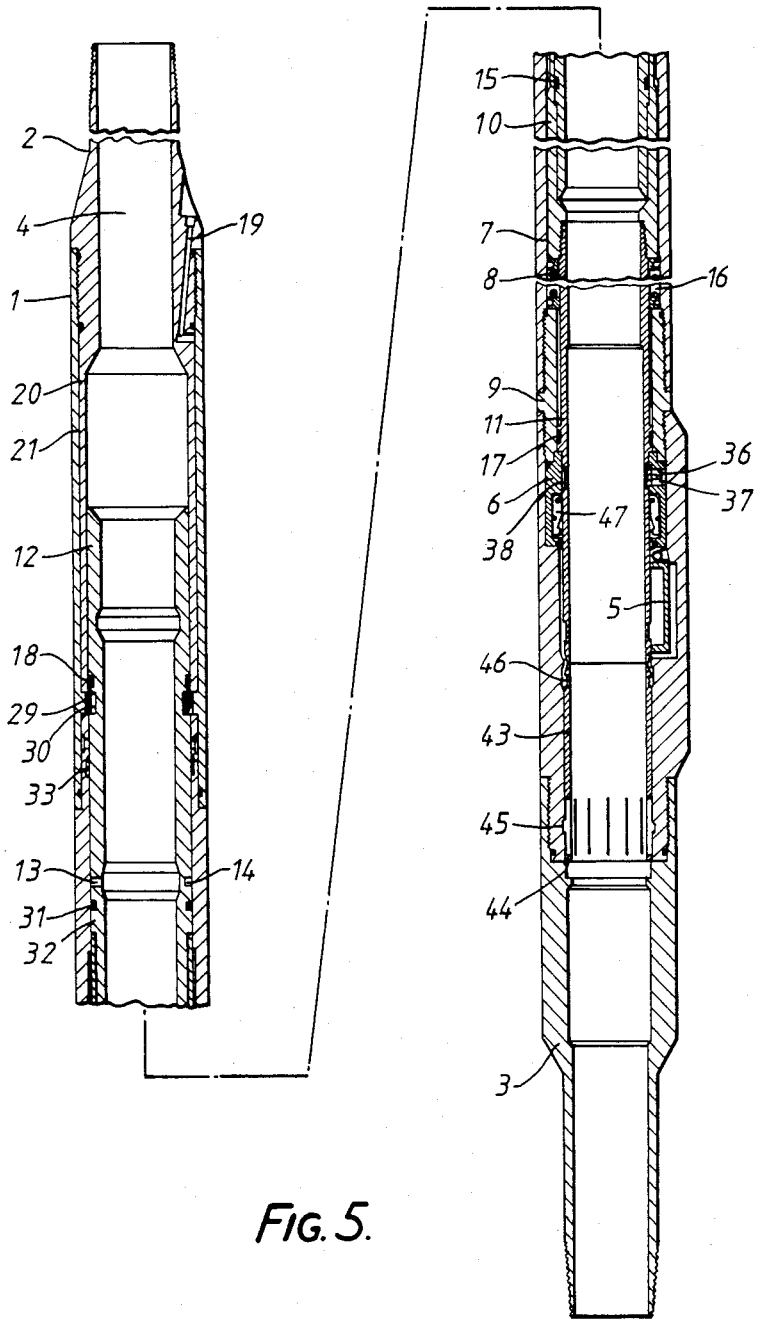
FIG. 5 shows, in longitudinal section, the embodiment of FIG. 1, with the valve member opened permanently as a result of the descent of the receptacle.

FIG. 5 shows the receptacle 12 after the shearing of the screw or screws 14 and plug 13 and after the receptacle has descended into its active position in which it keeps the piston tube 7 in its lower position and the valve member 5 open. To make the Figure simpler, the receptacle 12 is shown with the auxiliary valve or the actuating plug 22 omitted. The receptacle 12 is itself retained in the active position by a locking ring 29 which engages in a groove 30 of the body 1.

Figure 8:
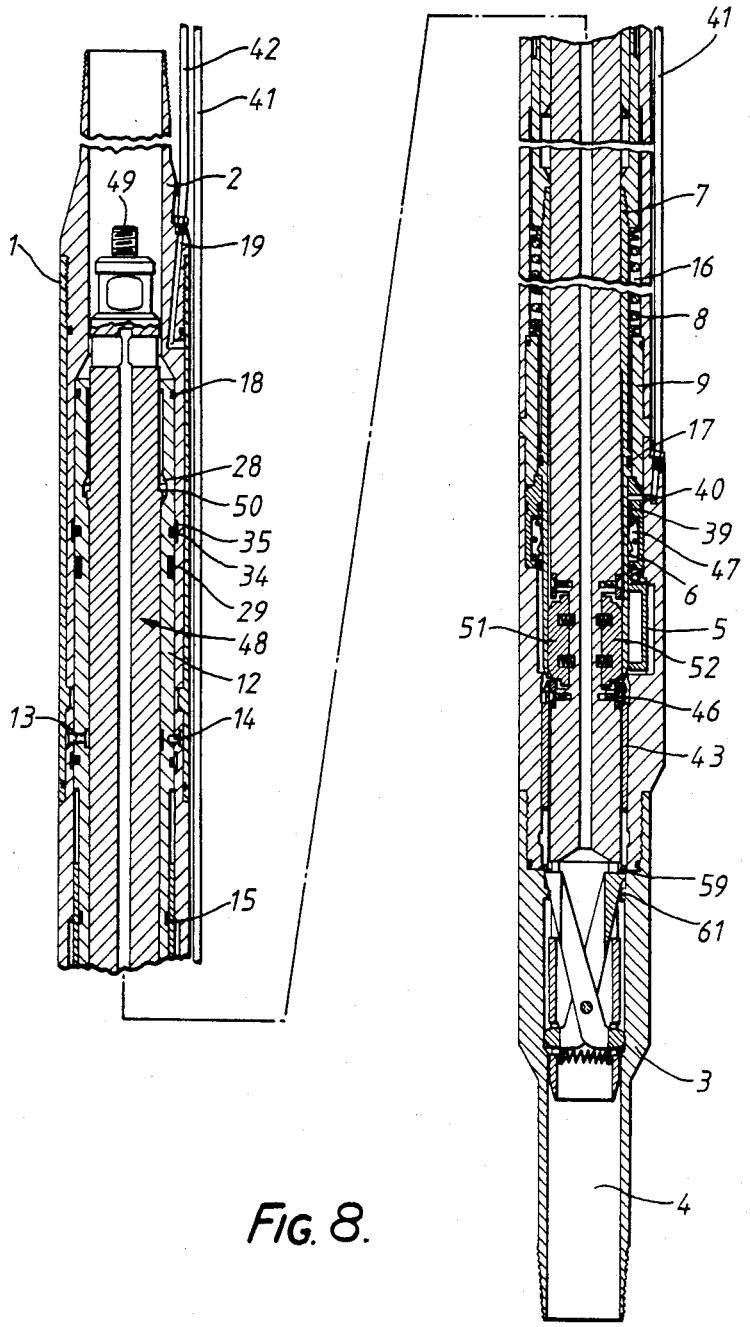
FIG. 8 shows, in longitudinal section, the tool of FIG. 7 in use in the embodiment of FIG. 1.

The hydraulic circuit for operating the valve member 5 is isolated during the use of the auxiliary valve by means of an auxiliary annular seal 31 which is provided on the receptacle 12 under the plug 13 and which seals against a bearing surface 32 of the body 1 in the active position of this receptacle 12, as shown in FIG. 5. In the inactive position of the receptacle 12, the seal 31 is located opposite a clearance groove 33 in the body 1. Thus, in the inactive position of the receptacle 12, the seal 31 is immersed in hydraulic fluid and does not undergo any mechanical stress. The locking ring 29 is also immersed in the hydraulic fluid. Advantageously, an additional annular seal 18 is provided on the receptacle 12, between the plug 13 and the upper annular seal 18, preferably above the locking ring 29. In the inactive position of the receptacle 12 the seal 34 is located opposite a second clearance groove 35 in the body 1, as shown in FIGS. 4 and 8, and, in the active position of the receptacle 12, the seal bears against a bearing surface of the body 1. In this way, the seals 31 and 34 which, in the active position of the receptacle ensure sealing on either side of the hole left in the wall of the receptacle 12 as a result of ejection of the plug 13, do not undergo any stress when the receptacle 12 is at rest in its inactive position, and are ready to perform their function effectively in the event of failure of the valve member 5 of the valve.

It will be noted that the restoring spring 8 is well protected from the effluent and is not at risk of being jammed in its seat since excess pressure of hydraulic fluid in the operating chamber tends to move apart the side walls delimiting the seat of the restoring spring.

In FIGS. 1, 2, 5 and 6, the valve member-holder 6 is shown provided with a lateral orifice 36 in which, according to the intended uses, a valve 37 for equalizing the pressure on either side of the valve member 5 can be introduced for facilitating opening of the valve member 5. The valve member 37 is closed when the piston tube 7 is in the upper position with a recess 38 opposite the valve, and opens when the piston tube 7 descends towards the valve member 5. The lateral orifice 36 can alternatively be plugged if there is no need for such pressure equalization. FIG. 4 shows a valve member-holder 6 without a lateral orifice.

FIG. 8 shows a valve member-holder 6 equipped with an extra annular seal 39 bearing against the piston tube 7, and an inlet 40 for an additional hydraulic control line 41, inlet 40 being provided in the valve member-holder 6 above the extra annular seal 39. Hydraulic control line 41 enables compensation of the effect on the piston tube of the hydrostatic pressure of the hydraulic fluid in the operating chamber (supplied via a main hydraulic control line 42 connected to the inlet 19) so that the valve can be used at very great depths.

Figure 6:
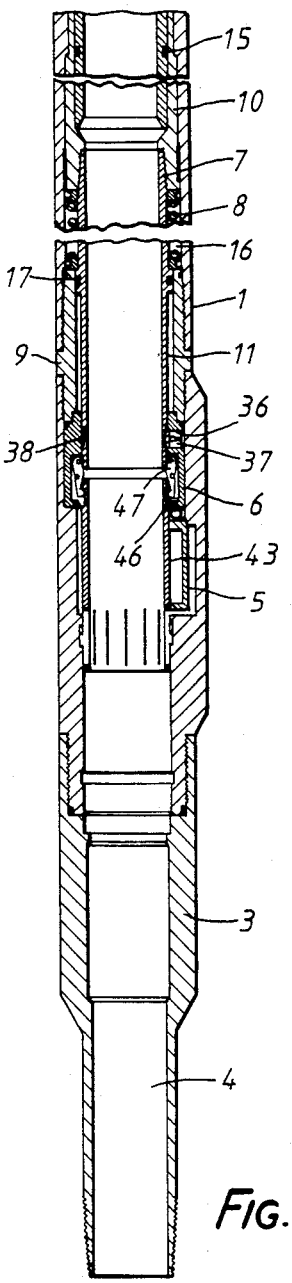
FIG. 6 shows, in longitudinal section, a part of the embodiment of FIG. 1, with the valve member in a temporary open position.

A means of keeping the valve member 5 temporarily in its open position is provided, for example to enable repair work to be carried out on the hydraulic control circuit. For this purpose, a sleeve 43 is installed below the valve member 5 and is resilient in its lower part 44 so as to engage in an inner slot 45 in the valve body 1. The sleeve 43 is equipped in its upper part with a catching groove 46 for engaging a resilient latch 47, formed by pawls held resiliently by rings and carried by the valve member-holder 6, when the sleeve 43 is released from the slot 45 and moved upwardly into line with the open valve member 5 and the latch 47, as shown in FIG. 6.

Figure 7:
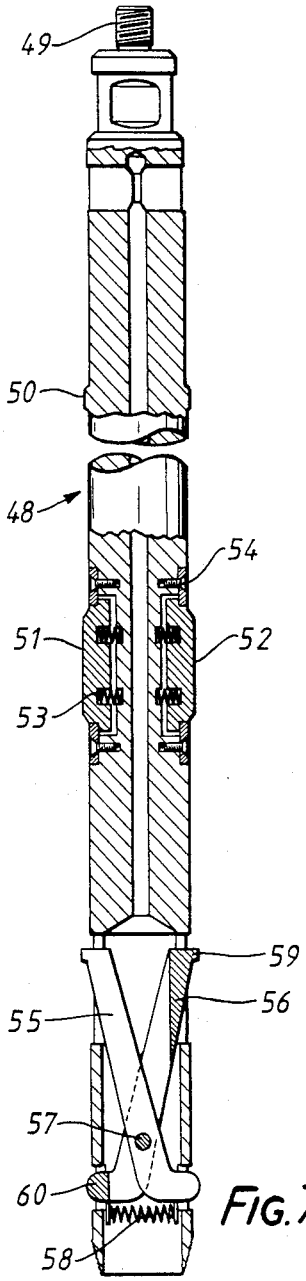
FIG. 7 shows, in elevation and partial longitudinal section, a tool for use with the embodiment of FIG. 1 for manipulating an auxiliary tube for the forced temporary opening of the valve member.

To release the sleeve 43 and move it upwardly in the body 1, a tool 48 shown in FIG. 7 may be used. Tool 48, actuable by means of a cable,comprises an attachment head 49, a shoulder 50 for engagement in the profile 28 of the body 1, a set of two half-shells 51, 52, biased apart by springs 53, screws 54 for retaining the half-shells, which half-shells are for keeping the valve member 5 in the open position, and two grippers 55, 56 which are articulated on a pivot 57 and are biased apart by a spring 58. The grippers 55, 56 are provided at their ends with catch surfaces 59 and guide surfaces 60.

FIG. 8 shows the tool 48 installed in the valve and ready to lift the sleeve 43. The shoulder 50 is retained at the bottom of the profile 28, the half-shells 51 and 52 are in line with the valve member 5 which has been opened by the piston tube 7, and the catch surfaces 59 are spaced apart under the sleeve 43. The plays provided are such as to ensure that the sleeve 43 can only be grasped by the tool 48.

The hydraulic supply to the valve is then bled, causing the piston tube 7 to rise. The valve member 5 remains open because of the action of the half-shells 51 and 52. By knocking upwards with the tool 48, the sleeve 43 is released from the slot 45 and lifted by the tool 48 up to the upper position in which it is engaged and retained by the latch 47. At this point, the guide surfaces 60 come into contact with a boss 61 and are pivoted towards each other, thus freeing the catch surfaces 59 from the sleeve 43 to allow the tool 48 to be raised to the surface.

Unlocking is carried out very simply by supplying hydraulic fluid to the valve once again. The downward movement of the piston tube 7 retracts the latch 47 which releases the sleeve 43 which is returned to its lower position by the piston tube 7.

There is thus provided a safety valve of the type with a valve member and which is incorporated in a production tube, which, whilst itself being very reliable in operation, can, if it fails, easily be converted into a safety valve recoverable by means of a cable.

We claim:

1. A safety valve comprising an elongate generally cylindrical body for insertion longitudinally between successive elements of a production tube and providing a longitudinal passage, a valve member provided in a lower part of said body for closing said passage against upward flow, a piston tube for opening said valve member, a restoring spring for biasing said piston tube to an upper position, said piston tube being longitudinally slidable downwardly to a lower position for opening said valve member, an operating chamber for receiving pressurized hydraulic fluid and for moving said piston tube to its lower position, a tubular receptacle provided above said piston tube for receiving internally, if required, an auxiliary safety valve recoverable by means of a cable, said receptacle being in its lower part sealingly and telescopically engaged with said piston tube to form an assembly, a lower annular seal carried by said piston tube and sealing against said body, an upper annular seal carried by said receptacle and sealing against said body, said operating chamber comprising an annular chamber formed between said body and said assembly and bounded by said upper and said lower annular seals, shearable means comprising a screw and a closed through-plug arranged below said upper annular seal for maintaining said tubular receptacle in an inactive position fixed relative to said body, a locking ring provided externally on said tubular receptacle, at least one auxiliary annular seal provided on said tubular receptacle below said plug, wherein, on application of sufficient pressure in said longitudinal passage to shear said shearable means, said tubular receptacle is adapted to slide downwardly in said body to an active position, said piston tube being adapted to be driven thereby to its said lower position, said upper annular seal and said auxiliary annular seal sealing between said body and said receptacle, and said locking ring engaging a groove in said body when said tubular receptacle is in said active position.

2. A safety valve according to claim 1, wherein a groove is provided in said body opposite the position occupied by said auxiliary annular seal when said receptacle is in said inactive position.

3. A safety valve according to claim 2, wherein an additional annular seal is provided externally on said receptacle between said plug and said upper annular seal for sealing between said body and said receptacle when said receptacle is in said active position, and a groove is provided in said body opposite the position occupied by said additional annular seal when said receptacle is in said inactive position.

4. A safety valve according to claim 1, wherein said piston tube has an upper portion engaged telescopically with a lower part of said receptacle and which contacts said receptacle when said piston tube and said receptacle approach one another, and a lower portion about which is installed said restoring spring, said restoring spring bearing upwardly against said upper portion and downwardly against a tubular element which forms part of said body and against which said lower annular seal carried by said piston tube bears laterally.

5. A safety valve according to claim 4, comprising a valve member-holder provided with a lateral orifice for receiving a valve which is normally closed and which is opened as a result of lateral pressure of said piston tube when said lower end of said piston tube approaches said valve member in its downward movement.

6. A safety valve according to claim 4, comprising a valve member-holder carrying a resilient latch which is retractable by passage of said piston tube and which, in its non-retracted position, is adapted to engage the upper end of a sleeve for the temporary opening of said valve member, said sleeve being normally located in a seat of said body provided below said lower position of said piston tube, and which is movable upwardly by means of a tool actuated by means of a cable, to a position in which it is engaged by said resilient latch to ensure that said valve member is maintained open.

7. A safety valve according to claim 4, comprising a valve member-holder provided with an extra annular seal which bears laterally against said piston tube, and an inlet for an additional hydraulic control line is provided via said valve member-holder above said extra annular seal for compensating for the effect on said piston tube of the hydrostatic pressure prevailing in said operating chamber.

* * * * *